US009676016B2

(12) United States Patent
Stewart

(10) Patent No.: US 9,676,016 B2
(45) Date of Patent: Jun. 13, 2017

(54) SYSTEMS AND METHODS FOR DRAWING MATERIALS

(71) Applicant: Manchester Copper Products, LLC, Rockledge, FL (US)

(72) Inventor: Charles L. Stewart, Indialantic, FL (US)

(73) Assignee: Manchester Copper Products, LLC, Rockledge, FL (US)

( * ) Notice: Subject to any disclaimer, the term of this patent is extended or adjusted under 35 U.S.C. 154(b) by 341 days.

(21) Appl. No.: 14/034,167

(22) Filed: Sep. 23, 2013

(65) Prior Publication Data

US 2015/0082847 A1 Mar. 26, 2015

(51) Int. Cl.

*B21C 1/22* (2006.01)
*B21C 1/16* (2006.01)
*B21C 1/30* (2006.01)

(52) U.S. Cl.

CPC ..... *B21C 1/22* (2013.01); *B21C 1/16* (2013.01); *B21C 1/30* (2013.01)

(58) Field of Classification Search

CPC .... B21C 1/04; B21C 1/12; B21C 1/14; B21C 1/16; B21C 1/20; B21C 1/22; B21C 1/24; B21C 1/26; B21C 1/27; B21C 1/28; B21C 1/30; B21C 1/305; B21C 1/34

USPC ..... 72/20.1, 20.2, 31.06, 31.13, 278–283, 72/285, 287, 289–291; 700/146

See application file for complete search history.

(56) References Cited

U.S. PATENT DOCUMENTS

| | | | |
|---|---|---|---|
| 411,060 | A | 9/1889 | Robertson |
| 666,048 | A | 12/1900 | Foote |
| 2,002,966 | A | 5/1935 | Sparks |
| 2,596,552 | A | 5/1952 | Heimann |

(Continued)

FOREIGN PATENT DOCUMENTS

| | | |
|---|---|---|
| JP | 57130718 | 8/1982 |

OTHER PUBLICATIONS

'Control System' Wikipedia Article publically available Aug. 28, 2012 found using the Way Back Machine (https://archive.org/web/).*

(Continued)

*Primary Examiner* — Peter DungBa Vo
*Assistant Examiner* — Joshua D Anderson
(74) *Attorney, Agent, or Firm* — Ropes & Gray LLP; Jeffrey H. Ingerman

(57) ABSTRACT

Systems, devices, and methods are described for drawing materials. In certain embodiments, the material is metal tubing that is hollow along its length. The drawing system may include a first drawing machine that is fixed or stationary and a second drawing machine that moves relative to the first drawing machine. In certain embodiments, the position of the second drawing machine is determined with respect to a desired position, wherein the second drawing machine is downstream from the first drawing machine, and wherein the material is successively drawn by the first and second drawing machines. The drawing speed of the first drawing machine may be adjusted from a first speed to a second speed based on the determined position of the second drawing machine. A programmable logic controller may be provided to control, at least in part, operations of the drawing system.

13 Claims, 10 Drawing Sheets

(56) References Cited

U.S. PATENT DOCUMENTS

| | | | | | |
|---|---|---|---|---|---|
| 2,650,495 | A | * | 9/1953 | Norton | B21B 37/48 72/205 |
| 2,698,683 | A | | 1/1955 | Martin et al. | |
| 2,929,499 | A | | 3/1960 | Turner | |
| 2,988,211 | A | | 6/1961 | Kent et al. | |
| 3,222,900 | A | * | 12/1965 | Helsing | B21B 37/48 72/10.1 |
| 3,260,095 | A | | 7/1966 | Flanagan | |
| 3,339,396 | A | | 9/1967 | Carlson | |
| 3,605,466 | A | | 9/1971 | Kilcoin | |
| 3,779,055 | A | | 12/1973 | Goyffon | |
| 3,798,954 | A | | 3/1974 | Asari | |
| 3,852,875 | A | | 12/1974 | McAmis et al. | |
| 4,154,081 | A | | 5/1979 | Boshold | |
| 4,178,982 | A | | 12/1979 | Sevastakis | |
| 4,223,548 | A | | 9/1980 | Wagner et al. | |
| 4,300,378 | A | | 11/1981 | Thiruvarudchelvan | |
| 4,316,373 | A | | 2/1982 | Zilges et al. | |
| 4,399,676 | A | | 8/1983 | Noyori et al. | |
| 4,606,211 | A | | 8/1986 | Noyori et al. | |
| 4,622,841 | A | | 11/1986 | Yoshida | |
| 4,662,203 | A | | 5/1987 | Kanatani et al. | |
| 4,687,422 | A | * | 8/1987 | Fuchs, Jr. | B21C 23/005 417/345 |
| 4,805,434 | A | | 2/1989 | Komp et al. | |
| 4,825,677 | A | | 5/1989 | Bessey et al. | |
| 5,188,676 | A | | 2/1993 | Taylor | |
| 5,467,631 | A | | 11/1995 | Eberts et al. | |
| 5,666,846 | A | | 9/1997 | Chen et al. | |
| 5,678,442 | A | | 10/1997 | Ohba et al. | |
| 5,855,136 | A | | 1/1999 | Hausler et al. | |
| 6,018,975 | A | | 2/2000 | Frigerio | |
| 6,164,112 | A | * | 12/2000 | Frigerio | B21C 1/12 72/280 |
| 6,216,506 | B1 | | 4/2001 | Stevens et al. | |
| 6,715,332 | B2 | * | 4/2004 | Klingen | B21C 1/20 226/112 |
| 7,073,363 | B2 | | 7/2006 | Hergemoller | |
| 7,448,245 | B2 | | 11/2008 | Muschalik et al. | |
| 7,640,774 | B2 | | 1/2010 | Hashizume et al. | |
| 8,210,017 | B2 | | 7/2012 | Suzuki et al. | |
| 2002/0189315 | A1 | | 12/2002 | Klingen et al. | |
| 2005/0210948 | A1 | | 9/2005 | Bultmann | |

OTHER PUBLICATIONS

International Search Report and Written Opinion dated Jan. 7, 2015 for PCT/US2014/056727.

* cited by examiner

SYSTEMS AND METHODS FOR DRAWING MATERIALS

BACKGROUND

Cold work is the deforming of a material at ambient temperature, often by rolling or drawing. Drawing is the process of forcing a material to change its thickness or shape by pulling the material through a die. This causes a dense array of dislocations and disorders the material structure, resulting in an increase in yield strength and a decrease in ductility. Strengthening may occur because the large number of dislocations form dense tangles that act as obstacles to further deformation. Thus controlled amounts of cold work such as drawing can be used to vary the geometry and/or properties of the material.

Continuous drawing processes can improve the production of drawn materials by incorporating multiple draw reduction dies in series, which increases the number of reductions of the material in a given pass. A problem arises in such continuous drawing processes because the drawn material increases in speed between each reduction die as it is successively drawn. Variable drawing speeds at each draw reduction die can cause the drawn material to push and/or pull a downstream drawing apparatus. Accumulators or drums are therefore used between each drawing apparatus to take up excess material, by coiling or bending, as the material is successively drawn. In the context of drawing metal tubing, coiling of the tubing may not be possible without breaking the tubing, or at least changing dimensions of the tubing (e.g., by flattening), and bending of the tubing requires substantial space and can impart unwanted stresses on the drawn metal tubing.

SUMMARY

Disclosed herein are systems, devices, and methods for drawing materials. In certain embodiments, the systems, devices, and methods include first and second drawing machines for continuously drawing a material such as metal tubing. In certain embodiments, the first drawing machine is fixed or stationary, and the second drawing machine moves relative to the first drawing machine. The drawing speed of the first drawing machine may be controlled based on a determined position of the second drawing machine during operation.

In one aspect, the systems, devices, and methods include a method for drawing a material comprising determining a position of a second drawing machine with respect to a desired position, wherein the second drawing machine is downstream from a first drawing machine, and wherein the material is successively drawn by the first and second drawing machines, and adjusting a drawing speed of the first drawing machine from a first speed to a second speed based on the determined position of the second drawing machine. The determining may include detecting, using a sensor device, the position of the second drawing machine while the material passes from the first drawing machine to the second drawing machine. In certain implementations, the position of the second drawing machine is determined by a position of a linear bearing with respect to a guide rail upon which the linear bearing translates, and the desired position may be a center of the guide rail. In certain implementations, the material does not bend as it is successively drawn by the first and second drawing machines. In certain implementations, the material is elongated metal tubing having a hollow center.

In certain implementations, the adjusting causes the second drawing machine to move in a direction towards the desired position. The drawing speed of the first drawing machine may remain constant at the second speed until the second drawing machine reaches the desired position. In certain implementations, the drawing speed of the first drawing machine is variable from the second speed as the second drawing machine approaches the desired position. In certain implementations, the method further includes determining whether the second drawing machine is within a threshold distance of the desired position, and in response to determining that the second drawing machine is within the threshold distance, adjusting the drawing speed of the first drawing machine from the second speed to a third speed that may be between the first and second speeds. The second speed is decreased if the second speed is greater than the first speed, or the second speed is increased if the second speed is less than the first speed. In certain implementations, the adjusting causes the second drawing machine to move in a direction away from the desired position at a rate that is less than that prior to the adjusting.

In one aspect, a non-transitory computer-readable medium is provided for controlling at least in part the drawing of a material, the non-transitory computer-readable medium comprising instructions recorded thereon for determining a position of a second drawing machine with respect to a desired position, wherein the second drawing machine is downstream from a first drawing machine, and wherein the material is successively drawn by the first and second drawing machines, and adjusting a drawing speed of the first drawing machine from a first speed to a second speed based on the determined position of the second drawing machine. The determining may include detecting, using a sensor device, the position of the second drawing machine while the material passes from the first drawing machine to the second drawing machine. In certain implementations, the position of the second drawing machine is determined by a position of a linear bearing with respect to a guide rail upon which the linear bearing translates, and the desired position may be a center of the guide rail. In certain implementations, the material does not bend as it is successively drawn by the first and second drawing machines. In certain implementations, the material is elongated metal tubing having a hollow center.

In certain implementations, the adjusting causes the second drawing machine to move in a direction towards the desired position. The drawing speed of the first drawing machine may remain constant at the second speed until the second drawing machine reaches the desired position. In certain implementations, the drawing speed of the first drawing machine is variable from the second speed as the second drawing machine approaches the desired position. In certain implementations, the computer-readable medium further includes instructions recorded thereon for determining whether the second drawing machine is within a threshold distance of the desired position, and in response to determining that the second drawing machine is within the threshold distance, adjusting the drawing speed of the first drawing machine from the second speed to a third speed that is between the first and second speeds. The second speed is decreased if the second speed is greater than the first speed, or the second speed is increased if the second speed is less than the first speed. In certain implementations, the adjusting causes the second drawing machine to move in a direction away from the desired position at a rate that is less than that prior to the adjusting.

In one aspect, a method for drawing a material comprises determining a first parameter of a downstream drawing machine, wherein the first parameter is dependent on a second parameter of an upstream drawing machine, and wherein the material is successively drawn by the first and second drawing machines, comparing the determined first parameter of the downstream drawing machine to a desired parameter, wherein an absolute value difference between the respective parameters comprises a delta parameter, and adjusting the second parameter of the upstream drawing machine, wherein the adjusting reduces the delta parameter. In certain implementations, the first parameter is a position of the downstream drawing machine, the second parameter is a drawing speed of the first drawing machine, and the desired parameter is a desired position of the downstream drawing machine.

In one aspect, a system for drawing a material comprises a first drawing machine configured to receive the material, and a second drawing machine configured to receive the material downstream from the first drawing machine, wherein the second drawing machine comprises a frame that translates relative to a component upon which the frame is supported, and wherein the translation occurs while the first and second drawing machines are successively drawing the material. In certain implementations, the system further comprises a sensor that detects a position of the frame of the second drawing machine with respect to a desired position. In certain implementations, the system further comprises a processor configured to adjust a drawing speed of the first drawing machine from a first speed to a second speed based on the detected position of the frame of the second drawing machine.

In certain implementations, the frame is coupled to a linear bearing that translates upon the component, for example, a guide rail. In certain implementations, the first and second drawing machines are chain-type drawing machines. The first and second drawing machines may include respective chains configured to revolve at respective drawing speeds and thereby pull the material through a respective die at an entrance of the respective drawing machines. In certain implementations, the respective chains comprise a gripping element having at least one gripping portion that is sized and shaped to complement an outer diameter of the material. In certain implementations, the material does not bend as it is successively drawn by the first and second drawing machines. In some implementations, the second drawing machine comprises an upper frame and a lower frame, wherein the upper frame translates relative to the lower frame while the first and second drawing machines are successively drawing the material.

In one aspect, a system for drawing a material comprises first means for drawing the material, the first drawing means configured to receive the material, and second means for drawing the material, the second drawing means configured to receive the material downstream from the first drawing means, wherein the second drawing means comprises a frame that translates relative to support means, and wherein the translation occurs while the first and second drawing means are successively drawing the material. In certain implementations, the system further includes means for detecting a position of the frame of the second drawing means with respect to a desired position. In certain implementations, the system further includes means for adjusting a drawing speed of the first drawing means from a first speed to a second speed based on the detected position of the frame of the second drawing means.

In certain implementations, the frame is coupled to means for translating upon the support means. In certain implementations, the first and second drawing means are chain-type drawing machines. The first and second drawing means may include respective chains configured to revolve at respective drawing speeds and thereby pull the material through a respective die at an entrance of the respective drawing means. In certain implementations, the respective chains comprise means for gripping the material, the gripping means sized and shaped to complement an outer diameter of the material. In certain implementations, the material does not bend as it is successively drawn by the first and second drawing means. In some implementations, the second drawing means comprises an upper frame and a lower frame, and wherein the upper frame translates relative to the lower frame while the first and second drawing means are successively drawing the material.

Variations and modifications of these embodiments will occur to those of skill in the art after reviewing this disclosure. The foregoing features and aspects may be implemented, in any combination and subcombination (including multiple dependent combinations and subcombinations), with one or more other features described herein. The various features described or illustrated herein, including any components thereof, may be combined or integrated in other systems. Moreover, certain features may be omitted or not implemented.

BRIEF DESCRIPTION OF THE DRAWINGS

The foregoing and other objects and advantages will be apparent upon consideration of the following detailed description, taken in conjunction with the accompanying drawings, in which like reference characters refer to like parts throughout, and in which.

DETAILED DESCRIPTION

Figure 1:
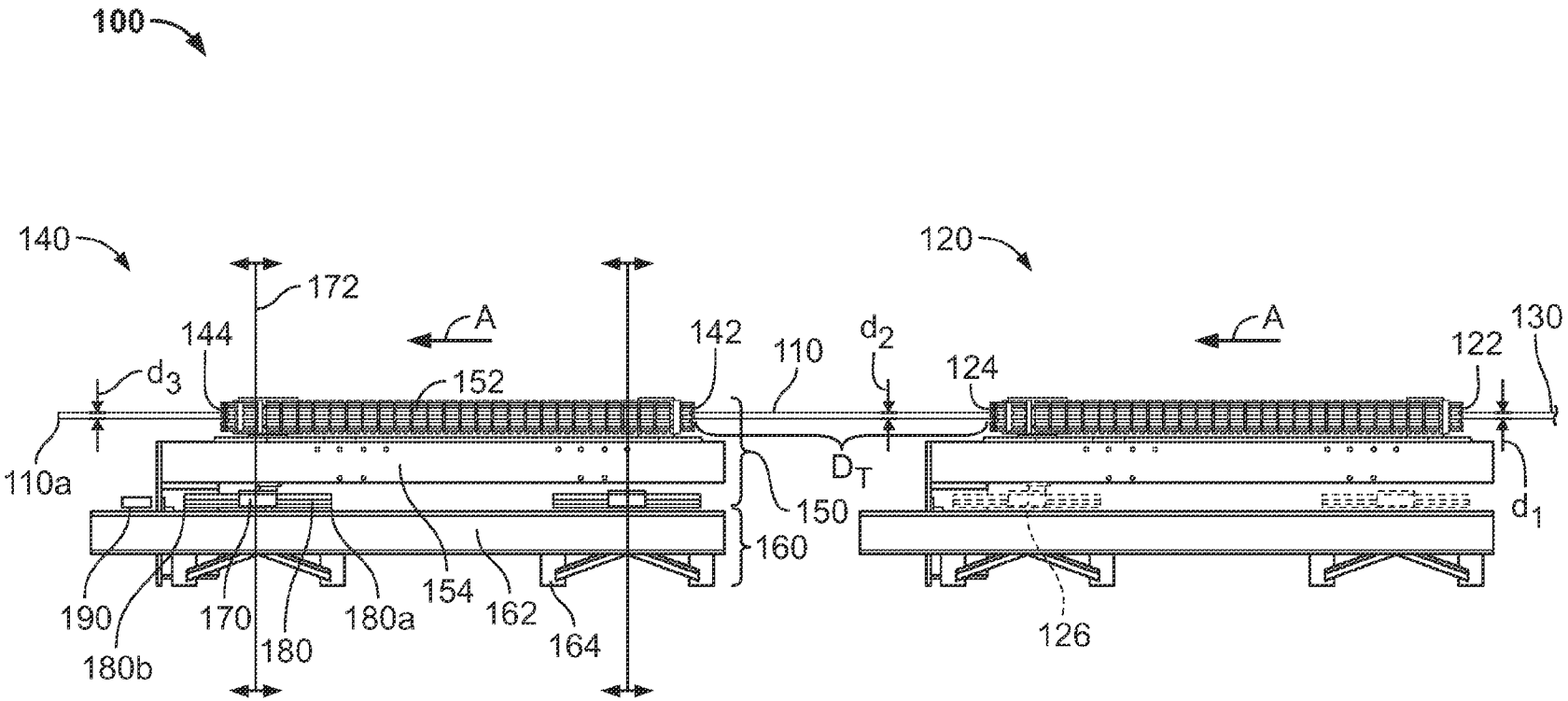
FIG. 1 shows a side elevation view of an illustrative drawing system that includes a first drawing machine and a second drawing machine arranged in a line for successively drawing a material.

To provide an overall understanding of the systems, devices, and methods described herein, certain illustrative embodiments will be described. Although the embodiments and features described herein are specifically described for use in connection with drawing systems, it will be understood that all the components, connection mechanisms, manufacturing methods, and other features outlined below may be combined with one another in any suitable manner and may be adapted and applied to systems to be used in other manufacturing processes, including, but not limited to cast-and-roll, up-casting, extrusion, and other manufacturing procedures. Furthermore, although embodiments described herein relate to drawing metal tubing that is hollow along its length, it will be understood that the systems, devices, and methods herein may be adapted and applied to systems for drawing or otherwise mechanically deforming any suitable type of material.

The systems, devices, and method described herein for drawing materials may be used in connection with materials formed from extrusion systems, including, for example, the extrusion press systems described in U.S. patent application Ser. No. 13/650,977, filed Oct. 12, 2012, the disclosure of which is hereby incorporated by reference herein in its entirety. For example, the drawing systems herein may be part of a finishing process for the extruded metal tubing formed by the above referenced extrusion press systems. The drawing systems may produce a drawn tube having any suitable number of draws, and the tubing can be finished in either straight length or coiled form.

The drawing systems may include a first drawing machine that is fixed or stationary and a second drawing machine that moves relative to the first drawing machine. The drawing speed of the first drawing machine may be controlled based on a determined position of the second drawing machine during operation. The movement of the second drawing machine accounts for varying speeds of the drawn material. There is thus no requirement for additional components, such as accumulators or drums, to take up the slack of the material between the two drawing machines as the material is successively drawn. Although an advantage of the drawing system herein is its ability to operate without such components, it will be appreciated that aspects of the present disclosure may nonetheless be applied to systems incorporating such components. A programmable logic controller, or PLC, controls all or a subset of operations of the drawing system while the system is set in automatic mode.

The drawing systems, devices, and methods described herein may be used for drawing a seamless extruded tubing product according to various seamless tubing standards including, for example, the ASTM-B88 Standard Specification for Seamless Copper Water Tube. The seamless extruded tubing of the present disclosure may also comply with the standards under NSF/ANSI-61 for Drinking Water System Components.

FIG. 1 shows a drawing system 100 according to certain embodiments. The drawing system 100 is used for drawing a material 110 through a first drawing machine 120 and a second drawing machine 140. The material 110 may be formed from any suitable material for use in drawing systems including, but not limited to, various metals including copper and copper alloys, or any other suitable non-ferrous metals such as aluminum, nickel, titanium, and alloys thereof, ferrous metals including steel and other iron alloys, polymers such as plastics, or any other suitable material or combinations thereof. Furthermore, as discussed above, the material 110 may be metal tubing that is hollow along its length. Although the material is discussed herein in the context of hollow metal tubing, it will be understood that the systems, devices, and methods may also apply to solid materials, and the materials may further have any suitable shape and/or cross-section. The material 110 enters the first drawing machine 120 at an entrance 122 and then exits the first drawing machine 120 at exit 124. The direction of travel along which the material 110 is drawn is denoted by arrow A. The outer diameter $d_2$ of the material 110 upon exiting the first drawing machine 120 is less than the outer diameter $d_1$ prior to entering the first drawing machine 120.

After exiting the first drawing machine 120, the material 110 is fed into an entrance 142 of the second drawing machine 140. Upon exiting the second drawing machine 140 at exit 144, the material 110 has been reduced to an outer diameter $d_3$, which is less than both outer diameter $d_2$ and outer diameter $d_1$. The material 110 has a leading edge **110*a* and extends back continuously to and beyond the portion illustrated by feed 130. Because the material 110 can be continuously drawn by the first and second drawing machines 120, 140 without interruption, there is no limit to the length of materials that may be drawn. Therefore, the feed 130 that provides the length of material may be holding equipment, such as large drums, that store lengths of the material in preparation for the drawing process. During operation of the present drawing system 100**, lengths of material on the order of 1-mile, and greater, have been continuously and uninterruptedly drawn. It will be understood that any suitable length of material may be drawn by system, devices, and methods of the present disclosure.

In certain embodiments, the first drawing machine 120 is mounted to the floor and remains in a fixed position, while the second drawing machine 140 is operable to move relative to the first drawing machine 120. For example, a first portion 150 of the second drawing machine 140 can move relative to a second portion 160 of the second drawing machine 140. The first portion 150 includes a tractor-type drawing apparatus or chain-type drawing apparatus 152 supported by an upper frame 154, which sits opposite a lower frame 162 of the second portion 160. The second portion 160 further includes legs 164 that may be mounted to the floor for securing the second portion 160 in place. During the drawing process, the first portion 150 moves relative to the second portion 160 by way of a linear bearing 170 coupled to the upper frame 154 and a guide rail 180 coupled to the lower frame 162. It will be understood that any suitable component may be used to allow relative movement of the drawing machine including, for example, roller bearings, wheels, any other suitable mechanism, and any combination thereof. In some embodiments, the component supports, at least in part, the upper frame 154 of the drawing machine. The relative movement of the second drawing machine 140 is caused by friction from the material 110 when the drawing speed of the second drawing machine 140 does not match the speed at which the material 110 enters the second drawing machine 140. As the material 110 is drawn through the first drawing machine 120, the speed of the exiting material 110 varies due to changes in the cross-sectional area. The material 110 enters the second drawing machine 140, which is then pushed (in a direction away from the first drawing machine 120) or pulled (in a direction towards the first drawing machine 120) due to the varying speed. Thus a difference in drawing speed and the speed of the material can cause a displacement of the second drawing machine.

In certain embodiments, the second drawing machine 140 is operable to move relative to the first drawing machine 120 without the use of both an upper and lower frame. For example, the second portion 160 of the second drawing machine 140 may simply include a guide rail (e.g., guide rail 180) that is mounted directly to the floor. The first portion 150 may include a tractor-type drawing apparatus or chain-type drawing apparatus 152 supported by a frame (e.g., upper frame 154), as described above, although in this case the frame sits opposite the floor rather than opposite a lower frame. During the drawing process, the first portion 150 moves relative to the second portion 160 by way of the linear bearing 170 coupled to the upper frame 154 and the guide rail 180 mounted to the ground (rather than coupled to a lower frame). Such embodiments may be desirable, for example, where the second drawing machine has a relatively large tractor-type or chain-type apparatus because the need for a proportionally sized (and in some cases, proportionally weighty) lower frame is eliminated by supporting the drawing apparatus with the floor. As discussed above, any suitable component that allows relative movement of the drawing machine and supports, at least in part, the frame of the drawing machine, can be used.

The displacement of the second drawing machine 140 is measured using a sensor 190. As shown in FIG. 1, the upper frame 154 is coupled to the linear bearing 170, which translates along the guide rail 180 coupled to the lower frame 162. The guide rail 180 has a first end 180*a* and a second end 180*b* which together define the outer limits of travel for the linear bearing 170. In certain embodiments, a mechanical stop or other structural component may be provided to bookend the guide rail 180 at the first and second ends 180*a*, 180*b* to prevent the linear bearing 170 from separating from the guide rail 180. Alternatively, or additionally, in certain embodiments, the PLC system may electronically prevent the linear bearing 170 from separating from the guide rail 180. The sensor 190 is used to determine the position of the linear bearing 170 with respect to a desired position 172 of that linear bearing 170. The desired position 172 may be a constant point or home position of the linear bearing 170. For example, in certain embodiments, it is preferable to position the linear bearing 170 at the center of the guide rail 180. From that central position, the linear bearing 170 is afforded the greatest amount of travel, whether towards or away from the first drawing machine 120, during the drawing process. The sensor 190 can therefore determine the position of the second drawing machine 140 relative to a desired position by way of measuring the position of the linear bearing 170 with respect to a desired position 172 on the guide rail 180.

The sensor 190 of the present disclosure may be any suitable transducer for detecting and reporting a parameter, including various position sensors (whether linear, angular, or multi-axis), potentiometers, including rheostats or variable resistor sensors, any other suitable transducers, or any combination thereof. Furthermore, the sensor 190 may be positioned in any suitable location for detecting and reporting a parameter, including locations on the drawing machine or locations away from the drawing machine. The location of the sensor 190 in FIG. 1, where the sensor 190 is separated from the object it senses (e.g., the linear bearing 170), is merely exemplary. For example, in some embodiments, the sensor 190 is a linear transducer that is coupled to the linear bearing 170 and moves, together with the linear bearing 170, to determine the position of the second drawing machine relative to a desired position. In such embodiments, the displacement of the linear transducer reflects the displacement of the linear bearing 170. Displacement can be measured, for example, using mechanical sensors, optical sensors, or any other suitable sensor or combinations thereof.

During operation, in certain embodiments an operator controls the drawing speed of the second drawing machine 140, and the PLC system controls the drawing speed of the first drawing machine 120 based upon the linear position of the second drawing machine 140. As a material is drawn through the first drawing machine 120, the speed of the exiting material varies due to changes in the cross-sectional area of the drawn material. This difference in speed is generally proportional to the change in the cross-sectional area. The material enters the second drawing machine 140, which is then pushed (in a direction away from the first drawing machine 120) or pulled (in a direction towards the first drawing machine 120) due to the varying speed. The second drawing machine 140 is allowed to linearly float on rails (e.g., approximately three feet in length) and a linear transducer is used to track the position. This position is used to control the drawing speed of the first drawing machine 120. For example, the drawing speed of the first drawing machine 120 is adjusted to keep the second drawing machine 140 in a desired position, such as the center position 172 of the guide rail 180. If the drawing speed of the first drawing machine 120 is faster than the drawing speed of the second drawing machine, the material will begin to push the second drawing machine 140 forward of the center position of the rails and the drawing speed of the first drawing machine 120 would be lowered. Conversely, if the first drawing machine is running slower than the second drawing machine, the material will pull the second drawing machine off center then the drawing speed of the first drawing machine 120 would be increased.

An advantage of the drawing system 100 of the present disclosure is that the distance $D_T$ between the two drawing machines 120, 140 may be relatively small compared to that required in other drawing systems having two drawing machines in a line with accumulators or other take-up components between the drawing machines. This relatively small distance $D_T$, on the order of a few feet, including for example as little as 5 feet, or less, allows the drawing process to be performed using fewer operators than other systems. For example, a single operator can stand at a terminal near the second drawing machine and observe all aspects of the drawing process. In some embodiments, for example, a translating drawing machine may have approximately 2 feet of travel, which would result in a distance $D_T$ of approximately 5-7 feet from a stationary drawing machine. At other distances, for example 6 feet, the travel would be approximately 6-8 feet. As discussed above, although an advantage of the drawing systems herein is the ability to operate without components such as accumulators, it will be appreciated that aspects of the present disclosure may nonetheless be applied to systems incorporating such components. Furthermore, although the drawing machines can be placed as close as a few feet from one another, in some embodiments, the drawing machines can be placed relatively farther apart, on the order of tens of feet or even hundreds of feet, according to system design and the translating drawing machine can be designed for any suitable length of travel.

Figure 2:
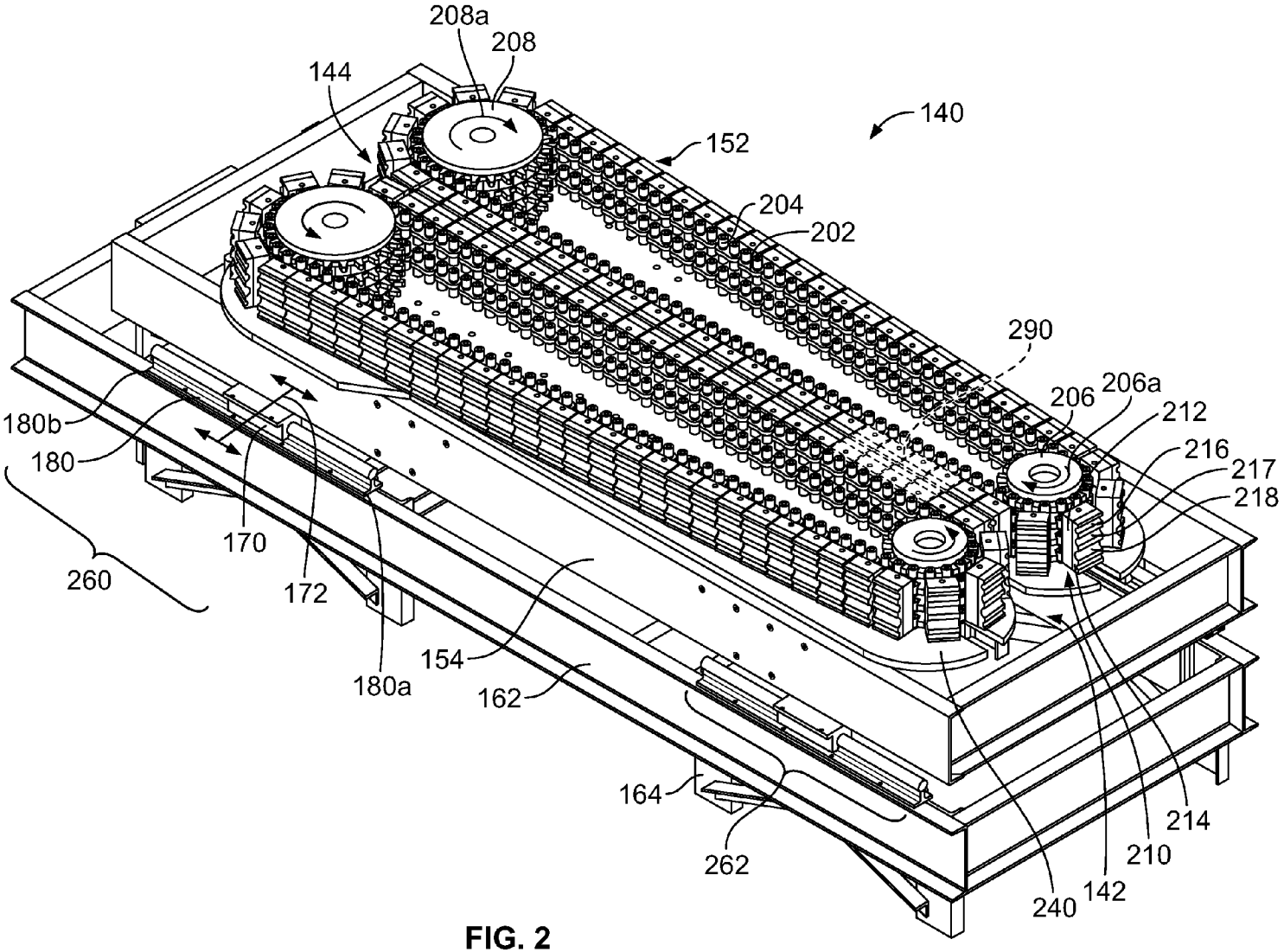
FIG. 2 shows a perspective view of an illustrative drawing machine having guide rails for moving the drawing machine relative to another drawing machine.

FIG. 2 shows a perspective view of the second drawing machine 140 of FIG. 1 according to certain embodiments. Although the figure is described with respect to the second drawing machine 140, any or all of the components may also be provided on the first drawing machine 120. In certain embodiments, the two machines are identical but for the features of the second drawing machine 140 that allow that machine to translate during the drawing process (depicted on the first drawing machine by dashed lines 126). In certain embodiments, the two machines are identical, but the translation components present in the first drawing machine are locked or otherwise prevented from translating. As shown in FIG. 2, the tractor-type or chain-type drawing apparatus 152 has a chain 202 that wraps around a front sprocket 206 and a rear sprocket 208, and the chain 202 revolves about the sprockets 206, 208 in the directions noted by arrows 206*a*, 208*a*. The chain 202 includes bushings 204 for interfacing with the sprockets 206, 208. The tractor drawing apparatus 152 operates using two chains that mirror one another and travel together for grabbing and pulling the material 110 through a die (not shown) positioned at the entrance 142 and then along the length of the drawing machine 140 to exit 144. At the bottom of the tractor-type drawing apparatus 152 is a bottom cover 240 (the top cover is omitted to show the otherwise hidden features of the tractor-type drawing apparatus). The bottom cover 240 (and the top cover) act as safety mechanisms during operation of the drawing system, for example, preventing inadvertent contact with the chains that revolve at relatively high rates of speed.

For receiving and pulling on the material 110, the tractor-type drawing apparatus 152 includes a plurality of gripping elements 210. The gripping elements 210 are formed from a block 212 coupled to the chain 202 and attached to a gripper 214. In certain embodiments, the gripper 214 is directly coupled to the chain 202 without using block 212. In certain embodiments, the gripper 214 has a plurality of gripping portions, each of which is operable to grip the material 110 as it passes through the drawing machine 140. For example, as shown in FIG. 2, the gripper 214 includes a first gripping portion 216, a second gripping portion 217, and a third gripping portion 218. Each of the respective gripping portions 216-218 is sized and shaped to accommodate a specifically sized material. For example, as shown in FIG. 2, the size or diameter of the respective gripping portions increases when comparing the first, second, and third gripping portions, and those gripping portions are sized and shaped to complement the particular gauge or diameter of material to be drawn. There are three gripping portions 216-218 shown in the figure, although it will be understood that in certain embodiments there may be additional or fewer gripping portions (e.g., two gripping portions), so long as there is at least one gripping portion that surrounds the material to be drawn and thereby pulls the material through the drawing machine 140. In certain embodiments, the gripping portions need not be sized or shaped to accommodate a particular material. For example, the gripping portions may be formed from a deformable material that, when placed around a material to be drawn, adapts to the shape of that material. This may allow for drawing non-standard sizes and shapes of materials.

Also shown in FIG. 2 is an assembly 260 that includes the linear bearing 170 and the guide rail 180. There are two such linear bearing/guide rail assemblies 260, 262 shown on one side of the drawing machine 140, and two additional linear bearing/guide rail assemblies (not shown) are provided on the opposite side of the drawing machine 140. It will be understood that there may be additional or fewer linear bearing/guide rail assemblies, or translation assemblies, provided on the drawing machine 140, and the translation assemblies may be provided in any location. For example, in some embodiments, there may be three translation assemblies arranged in a generally triangular formation. A first assembly may be positioned where the assembly 260 is shown in FIG. 2, with a second assembly on the opposite side, and a third assembly provided under the entrance 142 of the second drawing machine 140 (e.g., beneath the die). As another example using three translation assemblies, the first two assemblies could be positioned on opposite sides near the entrance 142 of the second drawing machine 140, with a third assembly positioned under the exit 144 thereof. Furthermore, the frame sections 154, 162 serve as mounts for a motor, and related gearbox components, which are not shown to avoid overcomplicating the figures. The drawing system 100 may be operated, at least in part, by a PLC system that controls various aspects of the drawing machines 120, 140.

Figure 3:
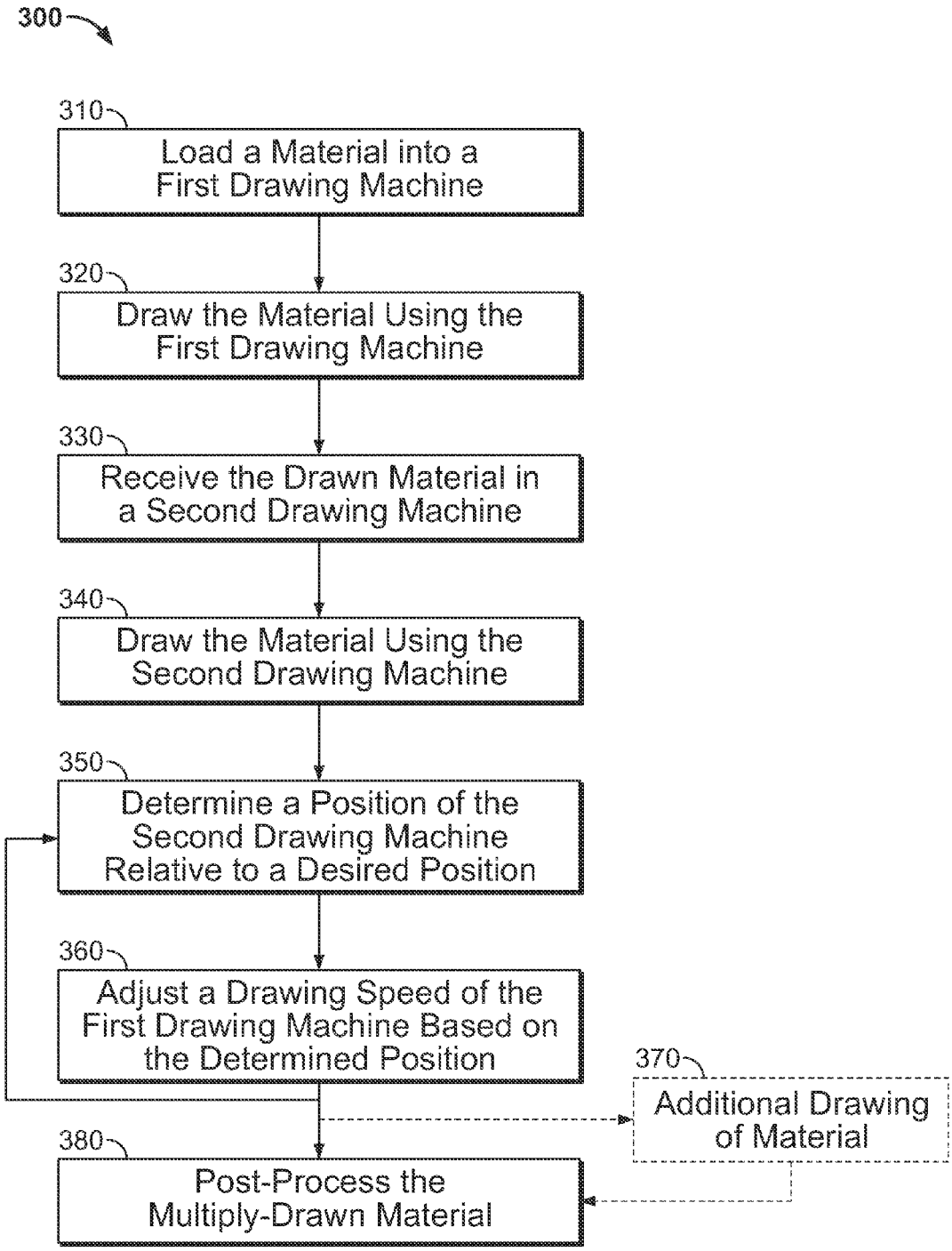
FIGS. 3 and 4 show illustrative flowcharts for operating the drawing system of FIG. 1.
Figure 4:
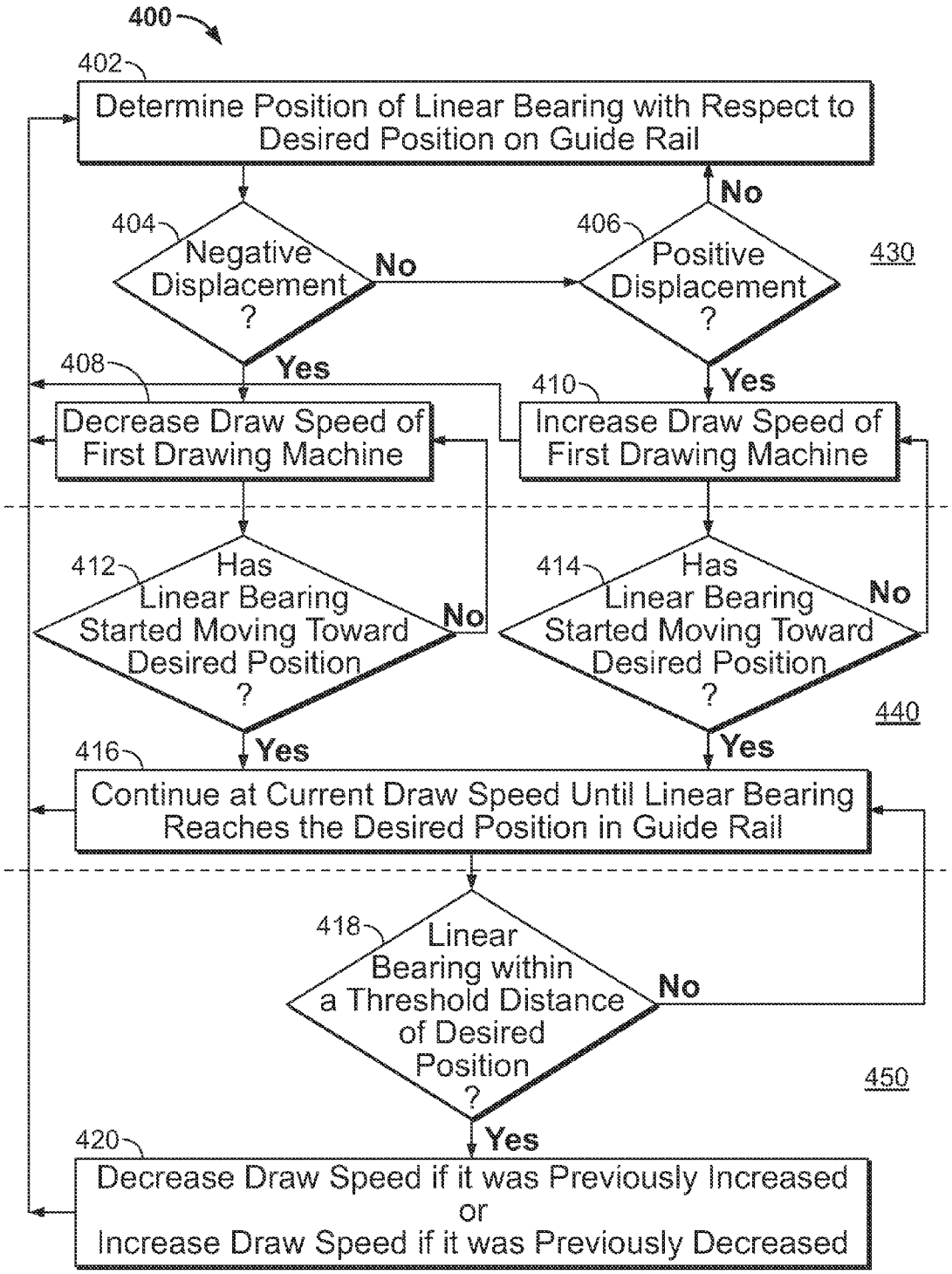

FIGS. 3 and 4 are flowcharts depicting processes for operating a drawing system, such as the drawing system 100 of FIG. 1, according to certain embodiments. It will be understood that the steps of the flowcharts of this disclosure are merely illustrative. Any of the steps of the flowcharts may be modified, omitted, or rearranged, two or more of the steps may be combined, or any additional steps may be added, without departing from the scope of the present disclosure.

Process 300 begins at step 310, where a material to be drawn is loaded onto the first drawing machine 120. In certain embodiments, that material is elongated metal tubing that is hollow along the length of the metal tubing. The first time the elongated tubing is loaded onto the first drawing machine 120, a point is formed at the leading edge 110*a* of the material 110, for example, by flattening the tube in the horizontal direction and then crushing the tube in the vertical direction. This allows the tubing to be threaded through the die. In certain embodiments, a floating plug or floating mandrel is positioned within the metal tubing prior to forming the point. During operation the floating plug/mandrel sets the inner diameter of the passing tubing while remaining on the upstream side of the die because its diameter is large enough to prevent it from passing through the die.

In some embodiments, the point is threaded through the die and into a mobile point grabber that is positioned behind the die. For example, in some embodiments, there is a void between grippers (e.g., void 290 of FIG. 2) into which the point grabber is positioned for grabbing the point and pulling the point along the length of the drawing machine. The point grabber moves together with the grippers and is removed once the grippers sufficiently grip the tubing. It will be understood that any suitable technique for pointing the leading edge 110*a* of the material and threading the material through the die may be used. After initially threading the point through the die and pulling the material with the point grabber, the grippers of the drawing machine (e.g., gripping element 210 of FIG. 2) can grip the metal tubing and pull the remaining length through the die. That is, after this initial pointing and threading, the material is automatically loaded for continuous drawing.

At step 320 the material is drawn using the first drawing machine 120. The material passes through a die, the diameter of which sets the new outer diameter of the material. The tractor-type or chain-type drawing apparatus applies a force to pull the material through the die. For example, the material fits into grooves of a plurality of gripping elements (e.g., gripping element 210 of FIG. 2), which operate collectively to pull the material along the length of the drawing machine 120. The length of the drawing machine 120 prevents doing all of the work at a single point, where undesirable stresses could cause deformations in the material at that point. In certain embodiments, lubricant can be applied to the material. For example, lubricant may be applied to the outer diameter of the material as it is drawn through the first drawing machine. In some embodiments, lubricant is applied to the inner diameter of the material before it is drawn through the drawing machine.

At step 330 the once-drawn material is received in the second drawing machine 140. The first time the material is received by the second drawing machine 140, the process is similar to that described above with respect to the first drawing machine 120. For example, the point already formed at the leading edge 110*a* of the material 110 may again be flattened and/or crushed to allow the tubing to be threaded through the second die (which in this case has a relatively smaller diameter than that of the first die). In some embodiments, the point already formed for the first drawing machine is removed and a new point is formed. As discussed above, a floating plug or floating mandrel may be positioned within the metal tubing prior to forming the point. During operation the floating plug/mandrel sets the inner diameter of the passing tubing while remaining on the upstream side of the die because its diameter is large enough to prevent it from passing through the die. Removing the point already formed for the first drawing machine allows the placement of a second floating plug or floating mandrel into the tubing. In some embodiments, the second floating plug/mandrel is already positioned into the tubing, for example, at the same time as placing the first floating plug/mandrel, and in such cases the same point can be used rather than forming a new point.

In some embodiments, the point is threaded through the second die and into a mobile point grabber that is positioned behind the second die. As discussed above, there may be a void between grippers (e.g., void 290 of FIG. 2) into which the point grabber is positioned for grabbing the point and pulling the point along the length of the drawing machine. It will be understood that any suitable technique for pointing the leading edge 110*a* of the material and threading the material through the die may be used. After initially threading the point through the second die and pulling the material with the point grabber, the grippers of the drawing machine (e.g., gripping element 210 of FIG. 2) can grip the metal tubing and pull the remaining length through the second die. That is, after this initial pointing and threading, the material is automatically loaded for continuous drawing. The material is received by the second drawing machine for successive drawing without interruption in the manufacturing process. This improves efficiency because the material can be drawn multiple times without the need to stop the process and rerun the material through the same drawing machine.

At step 340 the material is drawn using the second drawing machine. This process may be similar to that discussed above at step 320. The material passes through a die, the diameter of which sets the new outer diameter of the material. The tractor-type or chain-type drawing apparatus applies a force to pull the material through the die. For example, the material fits into grooves of a plurality of gripping elements, which operate collectively to pull the material along the length of the drawing machine 120. The length of the drawing machine 120 prevents doing all of the work at a single point, where undesirable stresses could cause deformations in the material at that point. In certain embodiments, lubricant can be applied to the material. For example, lubricant may be applied to the outer diameter of the material as it is drawn through the second drawing machine. In some embodiments, lubricant is applied to the inner diameter of the material before it is drawn through the drawing machine.

At step 350 a position of the second drawing machine is determined relative to a desired position, and at step 360 a drawing speed of the first drawing machine is adjusted based upon the determined position. The steps for adjusting the drawing speed of the first drawing machine based on a determined position of the second drawing machine are shown in FIG. 4 as a series of three subroutines 430, 440, 450. For example, subroutine 430 begins at step 402 when the PLC system determines a position of the linear bearing with respect to a desired position along the guide rail. A sensor such as sensor 190 may be used to determine the displacement of the linear bearing along the guide rail. The PLC system determines whether the displacement is negative (step 404) or positive (step 406). For example, a coordinate system may be used where the desired position is an axis, and a displacement away from the axis in a direction towards the sensor results in negative displacement, and a displacement away from the axis in a direction away from the sensor results in positive displacement. Based on the position of the sensor 190 in drawing system 100 of FIG. 1, negative displacement indicates movement of the second drawing machine away from the first drawing machine (in the direction of arrow A), and positive displacement indicates movement of the second drawing machine towards the first drawing machine (opposite the direction of arrow A).

Any suitable coordinate system may be used, and in some cases the discussion herein may also describe movement of the second drawing machine (or any component thereof including the linear bearing) in terms of an absolute distance and a direction from the desired position. Moreover, as discussed above, in some embodiments the sensor may be coupled to the object it senses (e.g., the linear bearing). In such embodiments, a similar coordinate system may be used where negative and positive displacement similarly indicates, respectively, movement of the second drawing machine away from and towards the first drawing machine.

Returning to decision block 404, the PLC system determines whether the displacement is negative. If the displacement is negative, the second drawing machine has moved in a direction away from the first drawing machine, and at step 408 the PLC system decreases the draw speed of the first drawing machine. In some embodiments, the draw speed of the first drawing machine can be reduced all the way to zero, for example, during start-up and shut-down phases. If the displacement is not negative, the PLC system then determines at step 406 whether the displacement is positive. If the displacement is positive, the second drawing machine has moved in a direction towards the first drawing machine, and at step 410 the PLC system increases the draw speed of the first drawing machine. If at step 406 the displacement is not positive, the process returns to step 402. In certain embodiments, after the draw speed of the first drawing machine has been decreased (at step 408) or increased (at step 410), the process returns to step 402 to again determine the position of the linear bearing with respect to a desired position on the guide rail. The subroutine 430 may then repeat the process as described. In some embodiments, this results in a continuous and gradual change in speed until the second drawing tractor is in the desired position.

In certain embodiments, subroutine 430 may continue to subroutine 440. For example, at step 412, the PLC system determines whether the linear bearing has started moving in a direction towards the desired position. This would indicate that the change in draw speed at step 408 has caused the linear bearing to change directions, from moving away from the desired position (in this case away from the first drawing machine) to moving towards the desired position (in this case towards the first drawing machine). If the linear bearing has not started moving in a direction towards the desired position, the draw speed is again decreased at step 408, a process that repeats until a change in direction is detected. Once the linear bearing has started moving in a direction towards the desired position, then at step 416, the PLC system maintains the current draw speed of the first drawing machine until the linear bearing reaches the desired position on the guide rail.

The process at step 414 is similar to that at step 412. At step 414, the PLC system determines whether the linear bearing has started moving in a direction towards the desired position. This would indicate that the change in draw speed at step 410 has caused the linear bearing to change directions, from moving away from the desired position (in this case towards the first drawing machine) to moving towards the desired position (in this case away from the first drawing machine). If the linear bearing has not started moving in a direction towards the desired position, the draw speed is again increased at step 410, a process that repeats until a change in direction is detected. Once the linear bearing has started moving in a direction towards the desired position, then at step 416, the PLC system maintains the current draw speed of the first drawing machine until the linear bearing reaches the desired position on the guide rail. In certain embodiments, after step 416, the process may return to step 402 to again determine the position of the linear bearing with respect to a desired position on the guide rail. Subroutines 430 and 440 may then repeat the process as described.

Figure 5:
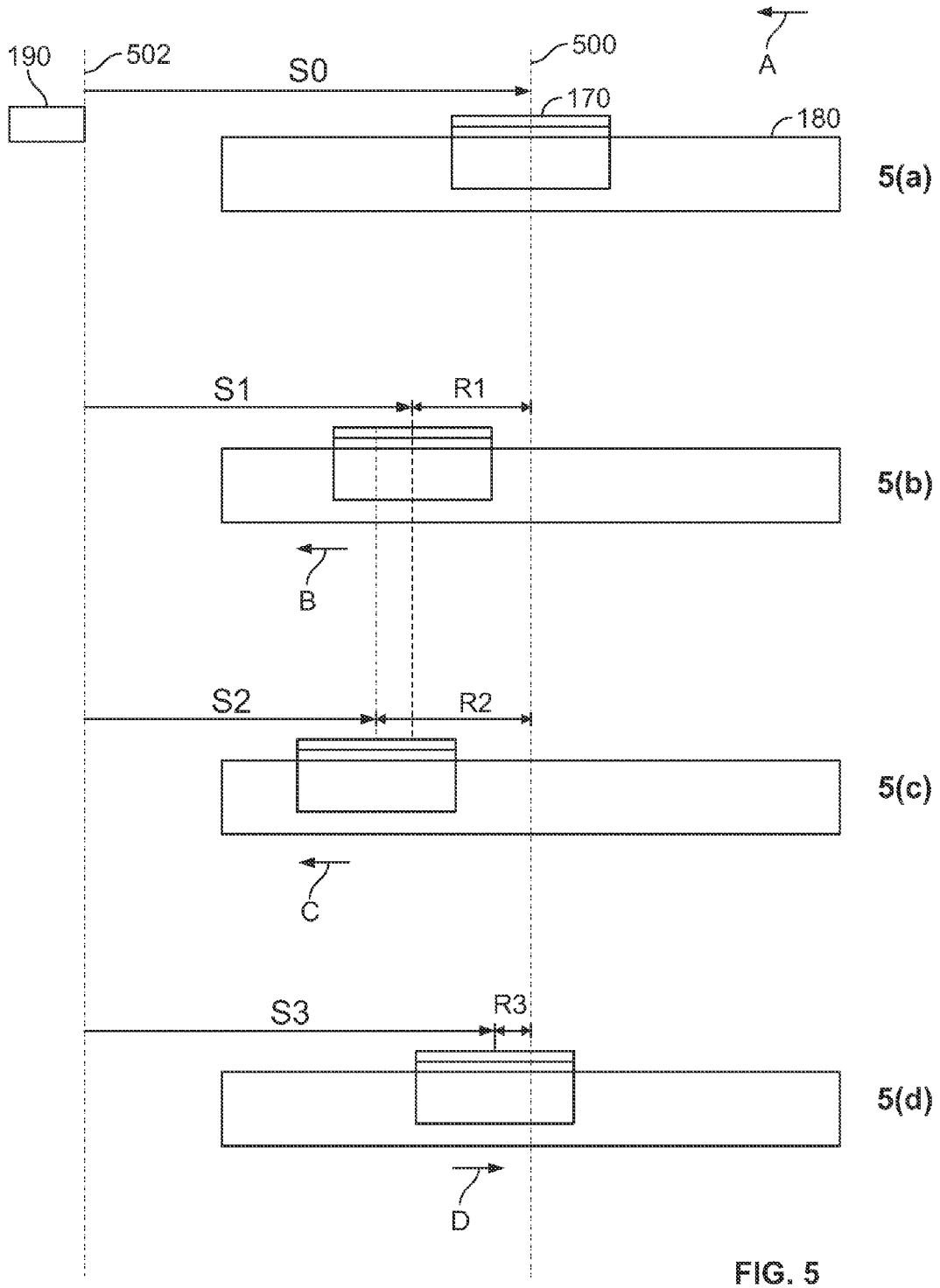
FIG. 5 shows various schematic views of the position of a linear bearing with respect to a guide rail during operation of the drawing system of FIG. 1.

In situations where the linear bearing does not quickly return to the desired position after decreasing (at step 408) or increasing (at step 410) the draw speed, subroutine 440 prevents the PLC system from making large-magnitude changes in the draw speed of the first drawing tractor. This situation is illustrated in FIG. 5. A coordinate system is shown as discussed above, where the desired position is an axis 500, the sensor 190 is positioned at a second axis 502, and a displacement towards the sensor (in the direction of arrow A) results in negative displacement, and a displacement away from the sensor (opposite the direction of arrow A) results in positive displacement. As discussed above, in some embodiments the sensor may be coupled to the object it senses (e.g., the linear bearing). In such embodiments, a similar coordinate system may be used where negative and positive displacement similarly indicates, respectively, movement of the second drawing machine away from and towards the first drawing machine.

As shown in FIG. 5, there are four illustrative positions 5(*a*) to 5(*d*) of the linear bearing 170 with respect to the guide rail 180, measured by the sensor 190 as positions S0-S3. In position 5(*a*), the linear bearing 170 is in the desired position 500, with a position reading by the sensor of S0. In position 5(*b*), the linear bearing 170 has moved an amount R1 towards the sensor in the direction of arrow B, and the sensor 190 would read a position S1 (negative displacement). According to subroutine 430, the draw speed of the first drawing machine would be decreased, thereby causing the linear bearing 170 to move away from the desired position 500 at a slower rate (from position 5(*b*) to position 5(*c*)) or causing the linear bearing 170 to change direction and move towards the desired position 500 (from position 5(*b*) to position 5(*d*)). Because the displacement relative to the desired position in both 5(*c*) and 5(*d*) is still negative (R2 and R3, respectively), regardless of the direction of travel (arrows C and D, respectively), subroutine 430 would continue decreasing the draw speed of the first drawing tractor. However, in the situation of 5(*d*), the linear bearing is already moving in a direction towards the desired position 500, and further decreasing the draw speed could result in the linear bearing increasing speed to a magnitude where the bearing overshoots the desired position. Subroutine 440 therefore avoids such a situation.

In certain embodiments, subroutine 440 may continue to subroutine 450. For example, at step 418 the PLC system determines whether the linear bearing is within a threshold distance of the desired position. For example, with reference to position 5(*d*) of FIG. 5, the linear bearing 170 is within a threshold distance R3 of the desired position 500. The threshold distance may be predetermined. If the linear bearing is within a threshold distance, the draw speed of the first drawing machine may be adjusted to account for the linear bearing 170 approaching the desired position. For example, if the draw speed was previously decreased at step 408, the draw speed is increased at step 420. Conversely, if the draw speed was previously increased at step 410, the draw speed is decreased at step 420. This provides a variable draw speed for the first drawing machine as the second drawing machine approaches the desired position. This allows the draw speed of the first drawing machine to approach a steady state when the second drawing machine nears the desired position. After step 420, the process may return to step 402 to again determine the position of the linear bearing with respect to a desired position on the guide rail. Subroutines 430, 440, and 450 may then repeat the process as described.

Although the drawing process has been described in the context of detecting the position of a downstream drawing machine with respect to a desired position, it will be understood that any suitable parameter of the downstream drawing machine that is dependent on a parameter of the upstream drawing machine can be determined and then used to adjust the drawing process by adjusting the parameter of the upstream drawing machine. For example, a parameter may be any measurable value of a form of energy, including electrical, mechanical, electromagnetic, chemical, acoustic, and thermal energy, and any combination thereof. In some embodiments, the determined parameter of the downstream drawing machine is compared to a desired parameter. For example, a detected position is compared to a desired position. This may involve comparing a difference between the determined parameter and the desired parameter. In embodiments where the parameters can have positive or negative values (e.g., positive and negative displacement), an absolute value difference between the determined parameter and the desired parameter is used. This difference represents a delta value or delta parameter between the measured parameter and the desired parameter. In order to minimize or reduce this delta parameter, the parameter of the upstream drawing machine (upon which the parameter of the downstream drawing machine depends) is adjusted. For example, in the context of measuring the position of the downstream drawing machine, as discussed above, the position is dependent on the drawing speed of the upstream drawing machine. Adjusting the upstream parameter (e.g., drawing speed) may reduce the delta parameter (e.g., the positional offset from a desired position).

Returning to process 300 of FIG. 3, additional drawing steps may be performed at step 370. In certain embodiments, this may include stopping the double-draw process and then rerunning the material through the first and second drawing machines. In other embodiments, additional drawing machines may be provided, and this step 370 may include running the material through the additional drawing machines. In certain embodiments, this step may be omitted.

At step 380 the multiply-drawn material is post-processed. For example, the material may be tested, sorted, identified, cut to length, and/or straightened. The drawing systems may produce a drawn tube having any suitable number of draws, and the tubing can be finished in either straight length or coiled form. With respect to drawn metal tubing, at the testing and sorting step, the tube is eddy current tested. A length encoder provides information to the PLC system, which identifies the position of any defects and optionally paints the defects. The PLC system then sorts cut-to-length-tube having eddy current indications that indicate no defects are present. At the identification step, the tubing may be indent marked and/or painted along its length. For painting, the PLC system uses a length encoder to provide feedback to the painting system so that the printed message is properly printed for various line speeds. Cutting the tubing to length also involves using a length encoder to control the cut length. The straightening process is generally a non-powered process, and the tube is manually pushed through a straightening unit (although this process could be automated). It will be understood that any suitable post-processing techniques may be applied following the drawing steps of the present disclosure.

Figure 6:
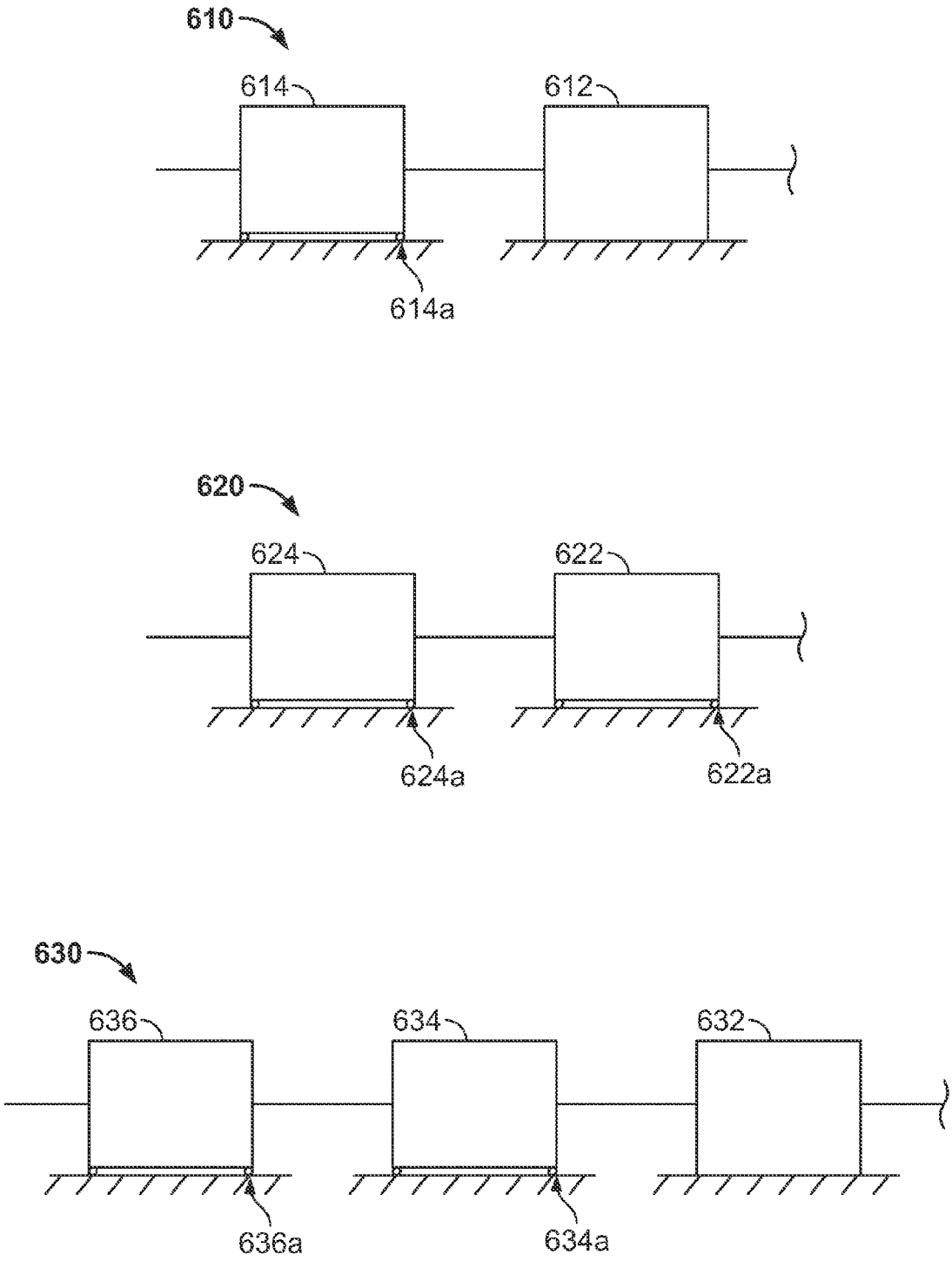
FIG. 6 shows various schematic views of illustrative drawing systems having at least two drawing machines arranged in a line for successively drawing a material.

As discussed above, the drawing system 100 has two drawing machines in a line, where the first drawing machine is stationary and the second drawing machine is movable relative to the first drawing machine. It will be understood that there are many variations to this system. For example, FIG. 6 shows several illustrative systems according to certain embodiments. A first system 610 includes a first drawing machine 612 that is fixed or stationary and a second drawing machine 614 that is movable relative to the first drawing machine. This is the arrangement of the system 100 of FIG. 1, where the second drawing machine 140 includes an assembly 260 (FIG. 2) for translating, and the first drawing machine 120 does not include such assembly. Returning to FIG. 6, the second drawing machine 614 has components 614*a* for moving or translating the second drawing machine 614 during operation. Although the drawing machines discussed thus far have been tractor-type or chain-type drawing machines, it will be understood that any suitable type of drawing machine may be used, as well as any suitable components for moving the drawing machine. As discussed above, an assembly that includes a linear bearing and a guide rail can be used for translation of the drawing machine. Other components for translating the drawing machine include ball bearings, rollers, wheels, springs, any other suitable translation components, or any combination thereof.

In certain embodiments, both of the drawing machines may be moveable relative to one another. For example, a second system 620 includes first and second drawing machines 622, 624 that are both movable relative to one another via components 622*a*, 624*a*. For example, referring to FIG. 1, the first drawing machine 120 may be provided with an optional assembly 126 to allow translation of that drawing machine. In certain embodiments, more than two drawing machines may be used for continuously drawing a material. For example, a third system 630 depicts three drawing machines 632, 634, 636 in a line where the first drawing machine 632 is fixed or stationary and the second and third drawing machines 634, 636 are both movable with respect to one another as well as with respect to the first drawing machine 632 via components 634*a*, 636*a*. In further embodiments, all drawing machines may be fixed or stationary, or all drawing machines may be movable relative to one another, or there may be any other combination of fixed and movable drawing machines.

Figure 7:
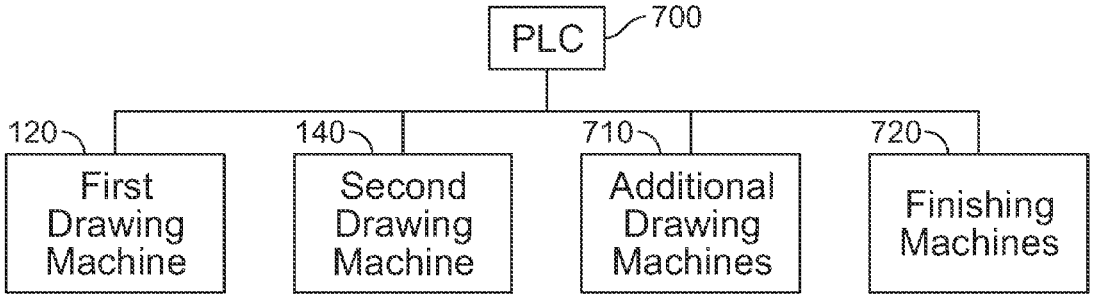
FIG. 7 shows a block diagram of an illustrative computer system for operating the drawing system of FIG. 1.

FIG. 7 shows a block diagram of a programmable logic control system for operating the drawing system of FIG. 1 according to certain embodiments. As discussed above, the drawing system 100 comprises a first drawing machine 120 and a second drawing machine 140 in line for successively drawing a material. In some embodiments, additional drawing machines 710 or other material finishing machines 720, such as a cutting subsystem, may be employed. Operation of certain components of any one or more of these systems 120, 140, 710, 720 may be controlled by the PLC system 700. Various operational steps of the drawing system 100 are described above with reference to process 300 of FIG. 3.

Instructions for carrying out the methods of this disclosure for extruding a material may be encoded on a machine-readable medium, to be executed by a suitable computer or similar device to implement the methods of the disclosure for programming or configuring PLCs or other programmable devices with a configuration as described above. For example, a personal computer may be equipped with an interface to which a PLC can be connected, and the personal computer can be used by a user to program the PLC using suitable software tools.

Figure 8:
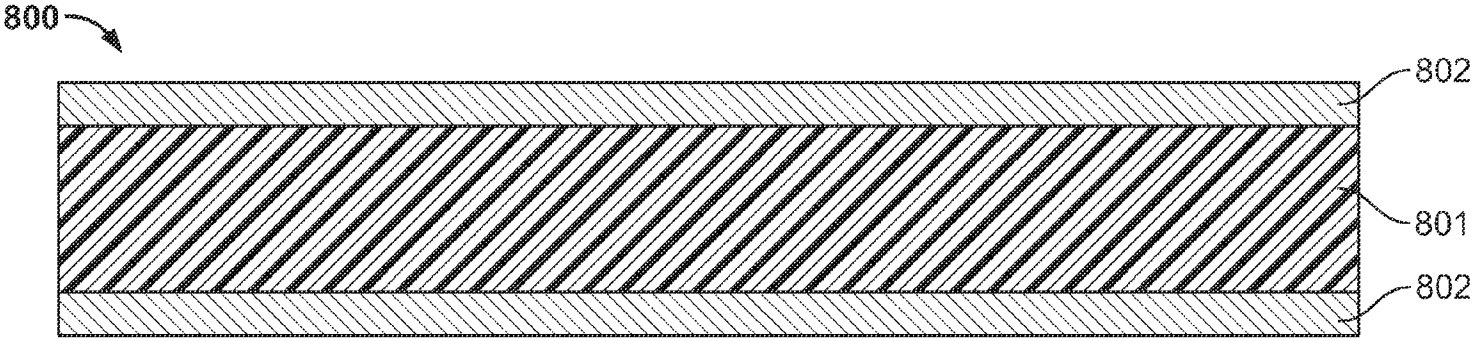
FIG. 8 shows a cross-sectional view of a magnetic data storage medium encoded with a set of machine-executable instructions for performing the methods of the present disclosure.

FIG. 8 shows a cross-section of a magnetic data storage medium 800 which can be encoded with a machine executable program that can be carried out by systems such as the aforementioned personal computer, or other computers or similar devices. Medium 800 can be a floppy diskette or hard disk, or magnetic tape, having a suitable substrate 801, which may be conventional, and a suitable coating 802, which may be conventional, on one or both sides, containing magnetic domains (not visible) whose polarity or orientation can be altered magnetically. Except in the case where it is magnetic tape, medium 800 may also have an opening (not shown) for receiving the spindle of a disk drive or other data storage device.

The magnetic domains of coating 802 of medium 800 are polarized or oriented so as to encode, in manner which may be conventional, a machine-executable program, for execution by a programming system such as a personal computer or other computer or similar system, having a socket or peripheral attachment into which the PLC to be programmed may be inserted, to configure appropriate portions of the PLC, including its specialized processing blocks, if any, in accordance with the present disclosure.

Figure 9:
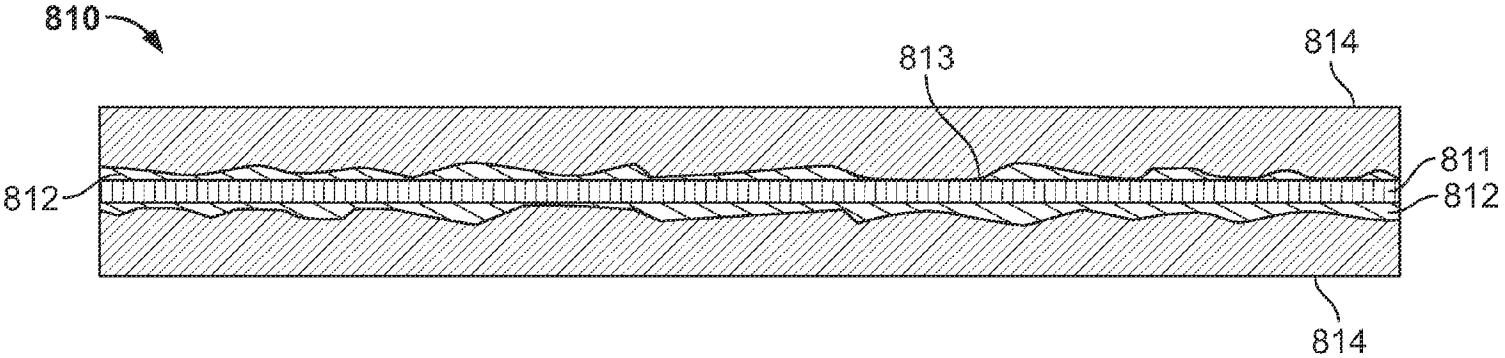
FIG. 9 shows a cross-sectional view of an optically readable data storage medium encoded with a set of machine-executable instructions for performing the methods of the present disclosure.

FIG. 9 shows a cross-section of an optically-readable data storage medium 810 which also can be encoded with such a machine-executable program, which can be carried out by systems such as the aforementioned personal computer, or other computers or similar devices. Medium 810 can be a conventional compact disk read-only memory (CD-ROM) or digital video disk read-only memory (DVD-ROM) or a rewriteable medium such as a CD-R, CD-RW, DVD-R, DVD-RW, DVD+R, DVD+RW, or DVD-RAM or a magneto-optical disk which is optically readable and magneto-optically rewriteable. Medium 810 preferably has a suitable substrate 811, which may be conventional, and a suitable coating 812, which may be conventional, usually on one or both sides of substrate 811.

In the case of a CD-based or DVD-based medium, as is well known, coating 812 is reflective and is impressed with a plurality of pits 813, arranged on one or more layers, to encode the machine-executable program. The arrangement of pits is read by reflecting laser light off the surface of coating 812. A protective coating 814, which preferably is substantially transparent, is provided on top of coating 812.

In the case of magneto-optical disk, as is well known, coating 812 has no pits 813, but has a plurality of magnetic domains whose polarity or orientation can be changed magnetically when heated above a certain temperature, as by a laser (not shown). The orientation of the domains can be read by measuring the polarization of laser light reflected from coating 812. The arrangement of the domains encodes the program as described above.

Figure 10:
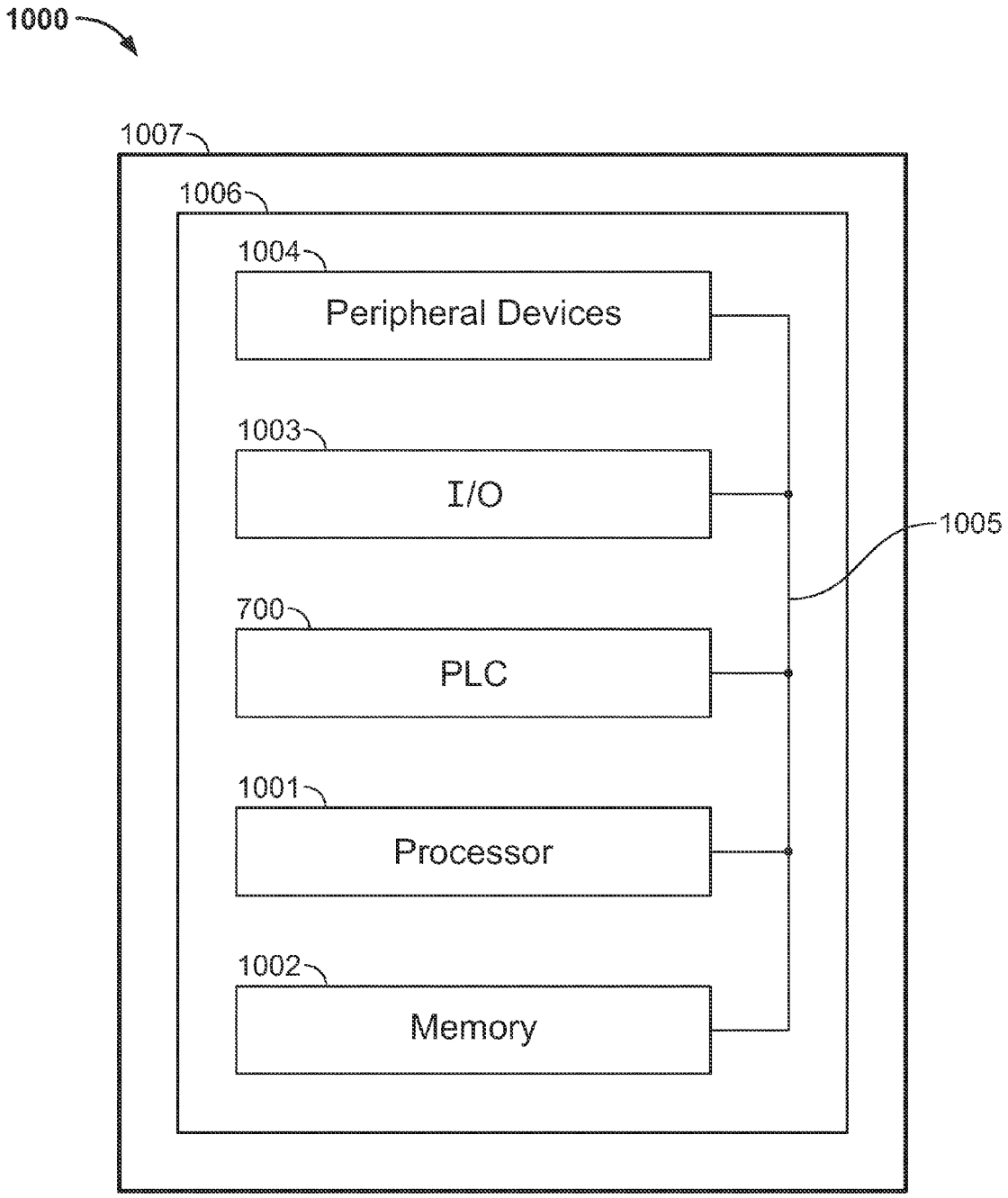
FIG. 10 shows a simplified block diagram of an illustrative system employing a programmable logic controller of the present disclosure.

A PLC 700 programmed according to the present disclosure may be used in many kinds of electronic devices. One possible use is in a data processing system 1000 shown in FIG. 10. Data processing system 1000 may include one or more of the following components: a processor 1001; memory 1002; I/O circuitry 1003; and peripheral devices 1004. These components are coupled together by a system bus 1005 and are populated on a circuit board 1006 which is contained in an end-user system 1007, which may include a terminal unit for operating a drawing system.

System 1000 can be used in a wide variety of applications, including as instrumentation for a drawing system, or any other suitable application where the advantage of using programmable or reprogrammable logic is desirable. PLC 700 can be used to perform a variety of different logic functions. For example, PLC 700 can be configured as a processor or controller that works in cooperation with processor 1001. PLC 700 may also be used as an arbiter for arbitrating access to a shared resources in system 1000. In yet another embodiment, PLC 700 can be configured as an interface between processor 1001 and one of the other components in system 1000. It should be noted that system 1000 is only exemplary. For example, in certain embodiments a user terminal may be provided near the drawing system. In other embodiments, a networked arrangement may be provided that may allow the user terminal to be remote from the drawing system.

Figure 11:
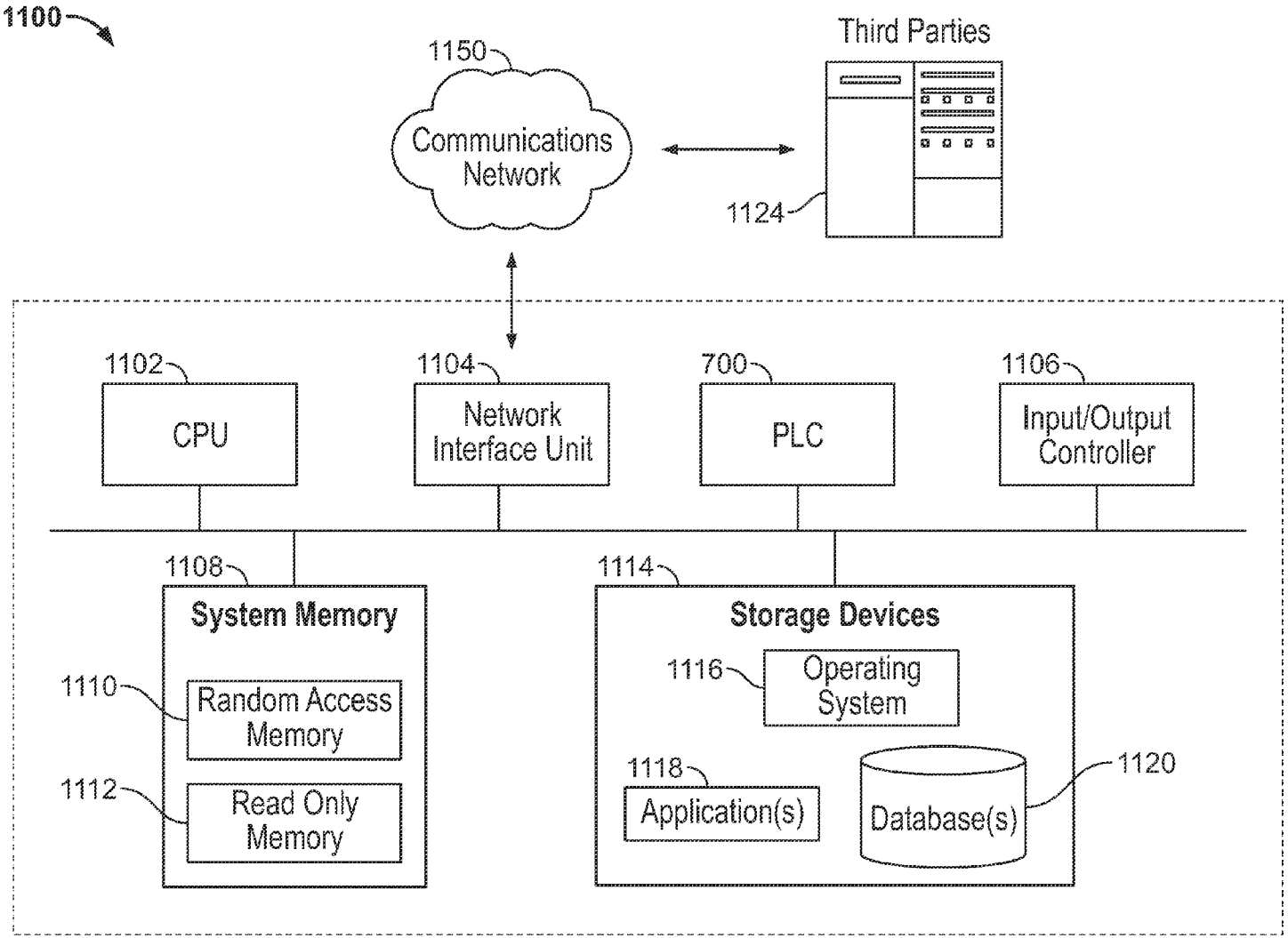
FIG. 11 shows a block diagram of an illustrative system employing a programmable logic controller of the present disclosure.

FIG. 11 is a block diagram of a computing device 1100 used for carrying out at least some of the drawing system logic processing described above according to certain embodiments. The computing device 1100 comprises a PLC system such as PLC 700, and at least one network interface unit 1104, an input/output controller 1106, system memory 1108, and one or more data storage devices 1114. The system memory 1108 includes at least one random access memory (RAM) 1110 and at least one read-only memory (ROM) 1112. All of these elements are in communication with a central processing unit (CPU) 1102 to facilitate the operation of the computing device 1100. The computing device 1100 may be configured in many different ways. For example, the computing device 1100 may be a conventional standalone computer or alternatively, the functions of computing device 1100 may be distributed across multiple computer systems and architectures. The computing device 1100 may be configured to perform some or all of the drawing system logic processing described above, or these functions may be distributed across multiple computer systems and architectures. In the embodiment shown in FIG. 11, the computing device 1100 is linked, via communications network 1150 or a local area network to third parties 1124 through the communications network 1150.

The computing device 1100 may be configured in a distributed architecture, where databases and processors are housed in separate units or locations. The computing device 1100 may also be implemented as a server located either on site at the drawing system facility or external to the drawing system facility. Some such units perform primary processing functions and contain at a minimum a general controller or a processor 1102 and a system memory 1108. In such an embodiment, each of these units is attached via the network interface unit 1104 to a communications hub or port (not shown) that serves as a primary communication link with other servers, client or user computers and other related devices. The communications hub or port may have minimal processing capability itself, serving primarily as a communications router. A variety of communications protocols may be part of the system, including, but not limited to: Ethernet, SAP, SAS™, ATP, BLUETOOTH™, GSM and TCP/IP.

The CPU 1102 comprises a processor, such as one or more conventional microprocessors, and one or more supplementary co-processors, such as math co-processors, for offloading workload from the CPU 1102. The CPU 1102 is in communication with the network interface unit 1104 and the input/output controller 1106, through which the CPU 1102 communicates with other devices such as other servers, user terminals, or devices. The network interface unit 1104 and/or the input/output controller 1106 may include multiple communication channels for simultaneous communication with, for example, other processors, servers or client terminals. Devices in communication with each other need not be continually transmitting to each other. On the contrary, such devices need only transmit to each other as necessary, may actually refrain from exchanging data most of the time, and may require several steps to be performed to establish a communication link between the devices.

The CPU 1102 is also in communication with the data storage device 1114. The data storage device 1114 may comprise an appropriate combination of magnetic, optical and/or semiconductor memory, and may include, for example, RAM, ROM, flash drive, an optical disc such as a compact disc and/or a hard disk or drive. The CPU 1102 and the data storage device 1114 each may be, for example, located entirely within a single computer or other computing device; or connected to each other by a communication medium, such as a USB port, serial port cable, a coaxial cable, an Ethernet type cable, a telephone line, a radio frequency transceiver or other similar wireless or wired medium or combination of the foregoing. For example, the CPU 1102 may be connected to the data storage device 1114 via the network interface unit 1104.

The CPU 1102 may be configured to perform one or more particular processing functions. For example, the computing device 1100 may be configured, via the PLC, for controlling at least in part one or more aspects of the first drawing machine 120, second drawing machine 140, additional drawing machines 710, and/or other finishing machines 720.

The data storage device 1114 may store, for example, (i) an operating system 1116 for the computing device 1100; (ii) one or more applications 1118 (e.g., computer program code and/or a computer program product) adapted to direct the CPU 1102 in accordance with the present invention, and particularly in accordance with the processes described in detail with regard to the CPU 1102; and/or (iii) database(s) 1120 adapted to store information that may be utilized to store information required by the program.

The operating system 1116 and/or applications 1118 may be stored, for example, in a compressed, an uncompiled and/or an encrypted format, and may include computer program code. The instructions of the program may be read into a main memory of the processor from a computer-readable medium other than the data storage device 1114, such as from the ROM 1112 or from the RAM 1110. While execution of sequences of instructions in the program causes the CPU 1102 to perform the process steps described herein, hard-wired circuitry may be used in place of, or in combination with, software instructions for implementation of the processes of the present invention.

The term "computer-readable medium" as used herein refers to any non-transitory medium that provides or participates in providing instructions to the processor of the computing device (or any other processor of a device described herein) for execution. Such a medium may take many forms, including but not limited to, non-volatile media and volatile media. Non-volatile media include, for example, optical, magnetic, or opto-magnetic disks, or integrated circuit memory, such as flash memory. Volatile media include dynamic random access memory (DRAM), which typically constitutes the main memory. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM or EEPROM (electronically erasable programmable read-only memory), a FLASH-EEPROM, any other memory chip or cartridge, or any other non-transitory medium from which a computer can read.

Various forms of computer readable media may be involved in carrying one or more sequences of one or more instructions to the CPU 1102 (or any other processor of a device described herein) for execution. For example, the instructions may initially be borne on a magnetic disk of a remote computer (not shown). The remote computer can load the instructions into its dynamic memory and send the instructions over an Ethernet connection, cable line, or even telephone line using a modem. A communications device local to a computing device (e.g., a server) can receive the data on the respective communications line and place the data on a system bus for the processor. The system bus carries the data to main memory, from which the processor retrieves and executes the instructions. The instructions received by main memory may optionally be stored in memory either before or after execution by the processor. In addition, instructions may be received via a communication port as electrical, electromagnetic or optical signals, which are exemplary forms of wireless communications or data streams that carry various types of information.

The foregoing is merely illustrative of the principles of the disclosure, and the systems, devices, and methods can be practiced by other than the described embodiments, which are presented for purposes of illustration and not of limitation. It is to be understood that the systems, devices, and methods disclosed herein, while shown for use in extrusion press systems, may be applied to systems, devices, and methods to be used in other manufacturing procedures including, but not limited to, cast-and-roll, up-casting, other extrusion, and other manufacturing procedures. Furthermore, the disclosure could be implemented as a post-processing step of another manufacturing process, including other extrusion processes, or could be implemented concurrently with another manufacturing process.

Variations and modifications will occur to those of skill in the art after reviewing this disclosure. The disclosed features may be implemented, in any combination and subcombination (including multiple dependent combinations and subcombinations), with one or more other features described herein. The various features described or illustrated above, including any components thereof, may be combined or integrated in other systems. Moreover, certain features may be omitted or not implemented.

Examples of changes, substitutions, and alterations are ascertainable by one skilled in the art and could be made without departing from the scope of the information disclosed herein. All references cited herein are incorporated by reference in their entirety and made part of this application.

What is claimed is:

1. A method for drawing a material comprising:

determining a position of a second drawing machine with respect to a desired position along a translational axis of the second drawing machine when the material is being continuously drawn by the second drawing machine and a first drawing machine without interruption, wherein the second drawing machine is downstream and translates relative to the first drawing machine, wherein the first drawing machine is stationary and being prevented from translating and from oscillating along the translational axis, wherein the first drawing machine draws the material at a drawing speed different from a drawing speed of the second drawing machine, and wherein the material is successively drawn by the first and second drawing machines; and adjusting the drawing speed of the first drawing machine from a first speed to a second different speed based on the determined position of the second drawing machine with respect to the desired position along the translational axis.

2. The method of claim 1, wherein determining the position of the second drawing machine comprises:

detecting, using a sensor device, the position of the second drawing machine while the material passes from the first drawing machine to the second drawing machine.

3. The method of claim 1, wherein the position of the second drawing machine is determined by a position of a linear bearing with respect to a guide rail upon which the linear bearing translates.

4. The method of claim 3, wherein the desired position is a center of the guide rail.

5. The method of claim 1, wherein adjusting the drawing speed of the first drawing machine causes the second drawing machine to move in a direction towards the desired position.

6. The method of claim 5, wherein the drawing speed of the first drawing machine remains constant at the second speed until the second drawing machine reaches the desired position.

7. The method of claim 5, wherein the drawing speed of the first drawing machine is variable from the second speed as the second drawing machine approaches the desired position.

8. The method of claim 7, further comprising:

determining whether the second drawing machine is within a threshold distance of the desired position; and in response to determining that the second drawing machine is within the threshold distance, adjusting the drawing speed of the first drawing machine from the second speed to a third speed that is between the first and second speeds.

9. The method of claim 8, further comprising decreasing the second speed if the second speed is greater than the first speed, or increasing the second speed if the second speed is less than the first speed.

10. The method of claim 1, wherein adjusting the drawing speed of the first drawing machine causes the second drawing machine to move in a direction away from the desired position at a rate that is less than that prior to adjusting the drawing speed of the first drawing machine.

11. The method of claim 1, wherein the material does not bend as it is successively drawn by the first and second drawing machines.

12. The method of claim 1, wherein the material is elongated metal tubing having a hollow center.

13. The method of claim 1, wherein the second drawing machine moves relative to the first drawing machine, and the drawing speed of the second drawing machine is constant.

* * * * *